US006868592B2

(12) United States Patent
Freiberg

(10) Patent No.: US 6,868,592 B2
(45) Date of Patent: Mar. 22, 2005

(54) STENTERING MACHINE

(75) Inventor: Helge Freiberg, Mönchengladbach (DE)

(73) Assignee: A. Monforts Textilmaschinen GmbH & Co., Mönchengladbach (DE)

( * ) Notice: Subject to any disclaimer, the term of this patent is extended or adjusted under 35 U.S.C. 154(b) by 0 days.

(21) Appl. No.: 10/486,856

(22) PCT Filed: Jun. 11, 2003

(86) PCT No.: PCT/DE03/01920

§ 371 (c)(1),
(2), (4) Date: Feb. 13, 2004

(87) PCT Pub. No.: WO03/106753

PCT Pub. Date: Dec. 24, 2003

(65) Prior Publication Data

US 2004/0237268 A1 Dec. 2, 2004

(30) Foreign Application Priority Data

Jun. 15, 2002 (DE) ..... 102 26 786

(51) Int. Cl.[7] ..... D06C 3/02
(52) U.S. Cl. ..... 26/89; 26/92; 26/96
(58) Field of Search ..... 26/87–96, 98, 26/106, 71–73, 51, 52, 53, 86; 264/288.4, 288.8, 289.3, 291, 290.2; 425/102, 75, 500, 503; 118/33, 34; 34/90, 619, 623, 660, 662, 664; 226/88, 102; 242/615.21; 28/165

(56) References Cited

U.S. PATENT DOCUMENTS 1,896,588 A * 2/1933 Laurie ..... 26/86
3,418,702 A * 12/1968 Coburn ..... 26/91
3,552,248 A * 1/1971 Pernick ..... 83/151
3,995,457 A * 12/1976 Kinomoto et al. ..... 68/13 R
4,103,403 A * 8/1978 Parrillo et al. ..... 26/91
4,134,189 A * 1/1979 Richter ..... 26/89
4,602,407 A * 7/1986 Gresens ..... 26/89
4,817,254 A * 4/1989 Poterala ..... 26/51.3
4,882,820 A * 11/1989 MacKinnon et al. ..... 26/93
4,949,438 A * 8/1990 Richter ..... 26/79
5,067,214 A * 11/1991 Hosmer et al. ..... 26/89
5,394,595 A * 3/1995 Rutz ..... 26/73
5,749,131 A * 5/1998 Breil et al. ..... 26/89
5,862,574 A * 1/1999 Poterala ..... 26/89

FOREIGN PATENT DOCUMENTS

| | | |
|---|---|---|
| DE | 1087555 | 8/1960 |
| DE | 3333938 | 4/1985 |
| EP | 0073915 | 3/1983 |
| GB | 1319470 | 6/1973 |

* cited by examiner

*Primary Examiner*—Amy B. Vanatta
(74) *Attorney, Agent, or Firm*—Collard & Roe, P.C.

(57) ABSTRACT

A stentering machine having a horizontal drying zone and a vertical pretreatment zone for a strip of material held spread out between tension chains configured as slide chains is described. The tension chains are brought from the vertical into the horizontal position in a deflection zone. In order to achieve the result that the slide pads that carry the tension chain, in each instance, make area contact with the related support guideways both in the horizontal, level region and in the curved region of the guide rails, the slide surfaces of the supporting slide pads that are affixed to the chain are divided into three consecutive zones, in the transport direction, namely a level edge zone, a curved center zone, and a second level edge zone.

4 Claims, 3 Drawing Sheets

STENTERING MACHINE

CROSS REFERENCE TO RELATED APPLICATIONS

Figure 1:
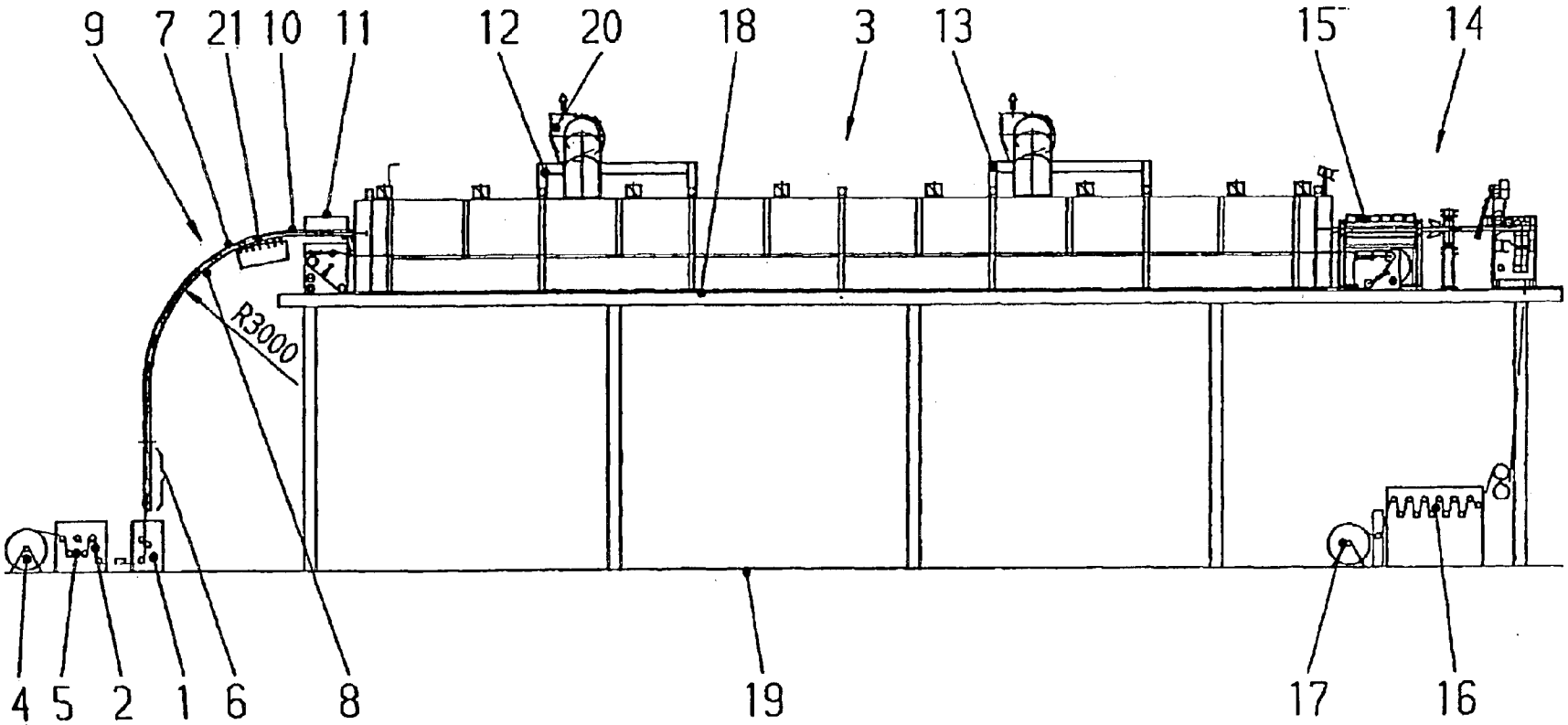

Applicants claim priority under 35 U.S.C. §119 of GERMAN Application No. 102 26 786.3 filed on Jun. 15, 2002. Applicants also claim priority under 35 U.S.C. §365 of PCT/DE03/01920 filed on Jun. 11, 2003. The international application under PCT article 21(2) was not published in English.

The invention relates to a stentering machine having a horizontal drying zone for continuous treatment of a strip of material held spread out between tension chains consisting of chain links, the two lengthwise edges of which can be releasably attached to the chain links in a coupling zone, whereby each of the chain links possesses a connection bolt to be coupled with an adjacent chain link, in each instance, in pivoting manner, and whereby the tension chains have guide rails with support guideways for slide pads of the chain links assigned to them, which are horizontal in the drying zone.

The tension chains are endless. Viewed in the strip transport direction, i.e. the chain running direction, they are deflected around shafts ahead of the coupling zone (needling-in field) and after an uncoupling zone (needling-out field), the axes of which shafts stand perpendicular or parallel to the adjacent goods surface and to the goods transport direction. In the case of conventional flat tenter frames, one speaks, in this connection, of a horizontal or vertical chain deflection, in other words of a deflection of the chain in a plane parallel or vertical to the plane of the strip of material.

There are stentering frame dryers having tension chains consisting of chain links, for a strip of material spread out between the tension chains, e.g. a textile material strip. The strip is held in needles or tenter hooks at its two lengthwise edges, and passed through a drying zone and, if applicable, through a fixing zone. Placing the strip edges on needles or tenter hooks takes place in a needling-in zone or hooking-in zone, called a coupling zone, in short. An example of such a tenter frame is described in EP 00 73 915 B1.

As a rule, the tension chains run in or on guide rails that absorb the weight of the tension chain and the strip of material carried by it, on the one hand, as well as the crosswise tension (crosswise to the strip transport direction), on the other hand. In the case of a normal flat tenter frame (having a single treatment plane), the guide rails essentially lie horizontally. They possess bearing guideways (support guideways) for slide pads of the chain links, which bear the weight of the chain (if applicable, including the strip of material). In addition, a tension roller track or tension guideway belongs to every guide rail and absorbs the crosswise tension exerted on the strip of material, in each instance. An example of a tension chain equipped with corresponding slide pads or slide elements is described in DE 33 33 938 A1. The slide pads themselves conventionally possess a level slide surface that is moved relative to the support guideway, in each instance, which is also level.

The present tenter machine is supposed to be suitable for drying a strip of material that has been pretreated, for example coated on both sides in a pretreatment zone, or a strip of material coated and/or dyed in the pretreatment zone, consisting of glass fibers or containing glass fibers. Coated strips of material are generally only allowed to be touched, e.g. passed around rollers to deflect them, once the coating has dried. Glass fibers frequently hold dyes less well than the surface of the rollers usually used in textile machines, so that the latter are not supposed to touch the surface of the strips of glass fiber material until after the substance applied has dried.

In devices in which a moving strip of material is supposed to be coated on both surfaces, the strip is drawn through the coating unit from the bottom to the top. The vertical guidance of the material has the advantage that the coating conditions are the same on both sides of the material, in contrast to horizontal guidance of the material. Since the freshly coated surface of the strip is only allowed to be touched after it has dried, the material is passed through a dryer arranged vertically above the coating unit, after it has come out of the latter. The method of procedure for drying glass fiber strips is very similar.

In the case of many grades of strips of material coming vertically from pretreatment, there is the need to control the strip width during drying. For this purpose, the strip of material is put into the tension chains described, stretched to a certain width, and passed to a vertical dryer. Since dryers can generally not be built to any desired height, because the production building is generally not high enough, it was proposed to bring the tension chain, with the strip of material that has already been coated on both sides, and stretched to a certain width, into a drying zone through a quarter-circle deflection zone (90° deflection zone) of the tension chains, on curved or bent guide rails (from the vertical into the horizontal), with a smooth transition into the horizontal position. The curved guide rails also possess curved (preferably concentric) support guideways.

As a result, the guide rail that is horizontal in the horizontal drying zone and curved at the transition to the pretreatment zone possesses level support guideways in its level regions as well as curved support guideways in its curved regions. The slide pads of the chain links can be assigned to the support guideways.

The slide pads, as stated, conventionally possess level slide surfaces, which slide on the support guideways in operation. The slide surfaces in question are supposed to be level, like the (horizontal) support guideways, so that the friction between the slide pad and the guideway occurs over an area, in other words not on a line or at a point. However, if the guideways are curved, in other words not level, in the deflection region of the guide rail, the slide pads touch the guideways at points or in lines in this region, so that relatively strong friction wear can occur. Although it would be possible to shape the slide surface of the slide pads in a hollow cylinder shape (e.g. by means of internal grinding), so that the slide pads are adapted to the shape of the curvature in the curved deflection region of the guideways, and therefore make contact over an area. Then, however, it would have to be accepted that on the level parts of the guideways, only the edges of the hollow cylinder shape make contact, and therefore will wear quickly.

The invention is based on the task of configuring a tenter frame chain that is carried to slide in the guide rails on guideways, in such a manner that the related slide pads of the chain links make contact with the support guideways of the guide rails over an area both in their level (horizontal) region and in their quarter-circle-shaped deflection region.

The solution according to the invention, for the tenter machine mentioned initially, consists of the fact that when there is a quarter-circle deflection zone of the guide rails and support guideways placed between a vertical pretreatment zone and a horizontal drying zone, the slide surfaces of the slide pads that face the support guideways possess a shaped center zone adapted to the curvature of the deflection zone, for area contact, and a level partial slide surface in the strip transport direction, ahead of and after (on both sides of) the center zone, in each instance, for smooth contact with the horizontal parts of the support guideways. Some improvements and additional embodiments of the invention are described in the dependent claims.

The individual slide pad according to the invention makes area contact with both the level parts and on the curved parts of the support guideways. This is achieved in that the slide pads that carry the chain possess a divided slide surface, the parts of which make area contact both in the curved region and in the level region of the support guideways, with a significant portion of their slide surface. It is practical if, in an individual slide pad, the rounded region of the slide surface assigned to the curved deflection zone lies approximately in the center of the length of this surface, viewed in the lengthwise chain direction. The radius of curvature of this rounded center zone of the slide pad surface is supposed to possess approximately the same value as the radius of curvature of the deflection zone of the guide rails. In order to keep the surface pressure on the curved part and in the level part equally great, it is advantageous to configure the length of the rounded part of the slide surface approximately the same size as the total of the length segments of the level parts of the slide surface.

Preferably, the invention relates to a stentering machine having a horizontal drying zone and a vertical pretreatment zone for a strip of material spread out between tension chains configured as slide chains. The tension chains are brought from the vertical position into the horizontal position in a deflection zone. In order to achieve the result that the slide pads that carry the tension chain, in each instance, make area contact with the related support guideways both in the horizontal, level region and in the curved region of the guide rails, the slide surfaces of the slide pads affixed to the chain are divided into three consecutive zones in the transport direction, namely a level edge region, a curved center region, and a second level edge region.

Figure 2:
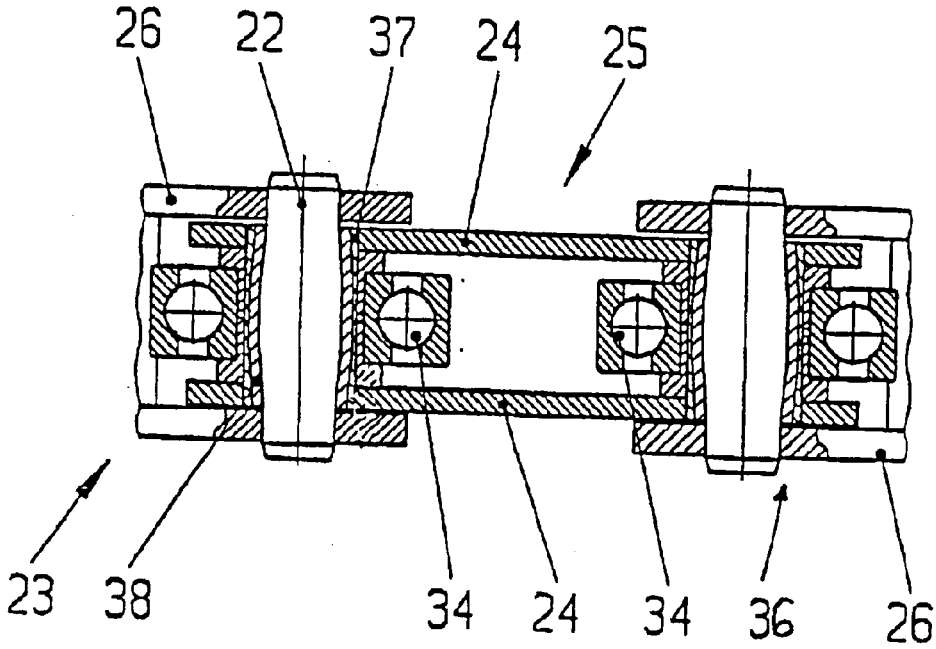
Figure 3:
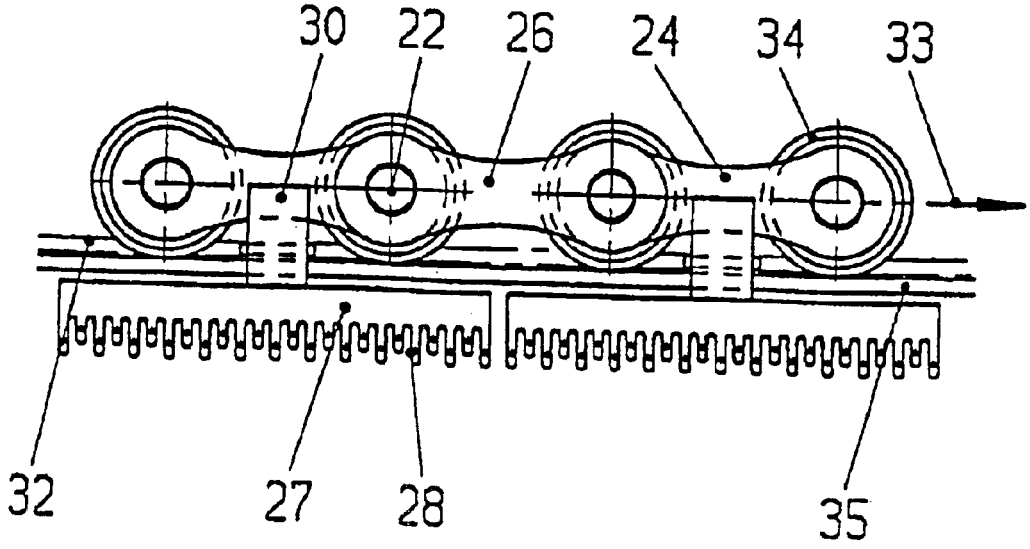
Figure 4:
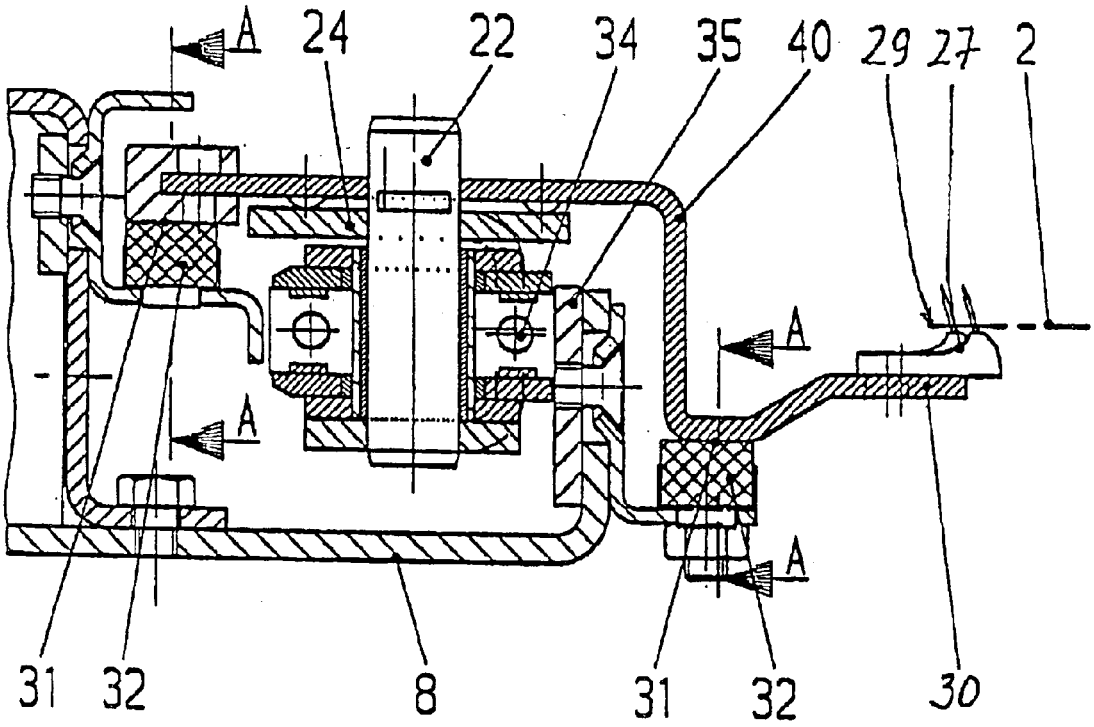
Figure 5:
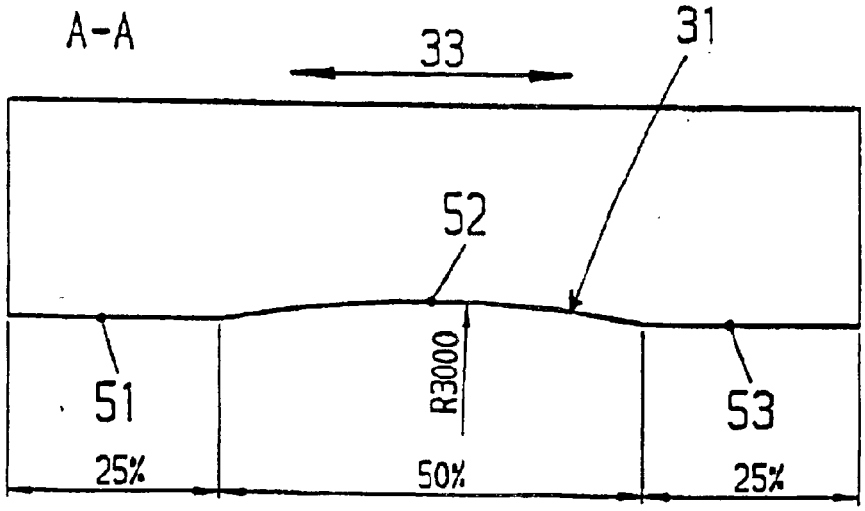

Details of the invention will be explained using the schematic representation of exemplary embodiments. These show:

FIG. 1 a cross-section through a device according to the invention, having a horizontal drying zone and a preceding vertical coating unit, FIG. 2 a magnified cross-section parallel to the drawing plane of FIG. 1, through a tension chain;

FIG. 3 a top view (from above) of a chain link from FIG. 2;

FIG. 4 a cross-section through a tension chain according to FIG. 1, with slide bearings to hold the tension chain; and FIG. 5 a cross-section (along line A—A of FIG. 4) of a slide pad to hold the chain weight of the chain according to FIG. 2 to 4.

FIG. 1 shows an exemplary embodiment of a device having a coating unit 1 for coating a strip of material 2 on both sides, with subsequent drying of the coating in a tenter frame dryer 3. The strip of material 2 is passed into the coating unit 1 from the roller 4, by way of strip tension regulators 5. There, the strip of material 2 is coated on both sides and drawn essentially vertically upward through a needling-in field 6 (coupling zone). Here, the edges of the strip of material are attached to tension chains 7 that run in guide rails 8. For this purpose, the chain links of the tension chain 7 can be equipped with conventional needle strips, i.e. needle strips that have already been used in series production until now. In the exemplary embodiment, the needling-in field 6 has a vertical length of about 2 m subsequent to the coating unit 1.

The needling-in field 6 is followed by a quarter-circle deflection zone 9, the radius of curvature R of which is supposed to be about 3 m in the exemplary embodiment. The deflection zone 9 can open out into the drying fields 12, 13, etc. of a conventional tenter frame dryer 3 at its upper end 10, horizontally, either directly or after having passed through an inspection zone 11, which can be 2 m long, for example. The dryer can possess one, two, three or more such drying fields, in conventional manner. In the exemplary embodiment, the drying fields are followed by a run-out zone 14, for example having a needling-out field 15 and a strip tension regulator 16 as well as a wind-up roller 17. With the dimensions indicated, the bottom 18 of the tenter frame dryer 3 lies about 5.5 m above the factory floor 19 (on which the coating unit 1 also stands), while the greatest height (the fans 20, in this case) of the system is about 9 m. Production buildings having this height are normal. The strip 2 can be supported by an air cushion 21 in the region of the deflection zone 9.

FIGS. 2 and 3 show a magnified representation of the tension chain 7 according to FIG. 1, having rollers to absorb the crosswise forces. FIG. 2 shows two connection bolts 22 of the tension chain 7. The tension chain consists of chain links 25 having so-called inside tabs 24 and chain links 23 having so-called outside tabs 26. The chain links 23 and 25 are held together by means of the connection bolts 22. According to FIG. 3, needle strips 27 are attached to the tabs 24. Each needle strip 27 possesses several needles 28, into which the lengthwise edge 29 (FIG. 4) of the strip of material 2 is hung. The needle strips 27 can be connected with the inside tabs 24 by way of stirrups 30.

The tension chain 7 runs in a transport direction 33 when the machine is in operation, and is tensed in this direction. Crosswise forces that act on the chain at the same time, from the strip of material 2 to be processed, are absorbed using rollers 34 that run on correspondingly shaped roller rails 35 of the guide rails 8 (FIG. 3). The rollers 34 are mounted on steel bushings 37, which coaxially surround the bolts 22, by way of slide bearings indicated as a whole as 36, according to FIG. 2. In the exemplary embodiment, the connection bolt 22 is mounted without lubricant in the steel bushing 37, in each instance, using a plastic bushing 38.

FIG. 4 shows a vertical cross-section through a tension chain link crosswise to the transport direction 33. In the chain according to FIG. 4, slide bearings are provided both for absorbing the crosswise forces and for absorbing the weight forces. The transport chain according to FIG. 4 contains connection bolts 22, which are connected with bottom and top inside tabs 24.

Within the scope of the present invention, two support guideways 32, in particular, are of significance, which are also to be attached to a part of the guide rail 8. In the exemplary embodiment, the guideways 32 absorb the weight forces of the chain 7. The support body 40 (with the appended chain) runs on the guideways 32 on the slide surface 31 (see also FIG. 3). It is attached to the support body 40 that also holds the stirrup 30 of the needle strip 27 in such a manner that the chain 7 is mounted to slide at all times on its path through the tenter machine.

The support guideways 32 lie horizontally in conventional flat tenter frames, as do the guide rails 8 overall. However, if the guide rails 8 are supposed to be suitable for deflecting the tension chain 7 from the horizontal position into a vertical position, for some reason, a curvature both of the guide rails 8 and of the guideways 32 is required in this deflection region.

While the slide surface 31 according to FIG. 5 is conventionally just as level throughout as the support guideway 32 itself, the slide surface 31 is divided according to the invention. According to FIG. 5, it consists of three consecutive parts, in the transport direction 33, a level region (level first partial slide surface 51), a cylindrical center zone (curved partial slide surface 52) having a radius of curvature R, and a second level region (level second partial slide surface 53). Preferably, the region 52 has approximately the same length, in the transport direction 33, as the sum of the regions 51 plus 53. During operation, the level partial slide surface 51 and 53 act as contact surfaces wherever the support guideway 32 is also level.

Reference Symbol List

1=coating unit
2=strip of material
3=tenter frame dryer
4=roller
5=strip tension regulator
6=needling-in field
7=tension chain
8=guide rail
9=deflection zone
10=top end (9)
11=inspection zone
12, 13=drying field
14=run-out zone
15=needling-out field
16=strip tension regulator
17=take-up roller
18=bottom (3)
19=factory floor
20=fan
21=air cushion
22=connection bolt
23=chain link
24=inside tab
25=chain link
26=outside tab
27=needle strip
28=needle
29=lengthwise edge (2)
30=stirrup
31=slide surface
32=support guideway
33=transport direction
34=roller
35=roller rail
36=slide bearing
37=steel bushing
38=plastic bushing
40=support body
51=level partial slide surface
52=curved partial slide surface
53=level partial slide surface

What is claimed is:

1. Stentering machine having a horizontal drying zone for continuous treatment of a strip of material (2) held spread out between tension chains (7) consisting of chain links (23, 25), the two lengthwise edges (29) of which can be releasably attached to the chain links (23, 25) in a coupling zone, wherein each of the chain links (23) possesses a connection bolt (22) to be coupled with an adjacent chain link (25), in each instance, in pivoting manner, and wherein the tension chains (7) have guide rails (8) with support guideways (32) for slide pads of the chain links (23, 25) assigned to them, which are horizontal in the drying zone, wherein when there is a quarter-circle deflection zone (9) of the guide rails (8) and support guideways (32) placed between a vertical pretreatment zone and a horizontal drying zone, slide surfaces (31) of the slide pads that face the support guideways (32) possess a shaped center zone (52) adapted to the curvature of the deflection zone (9), for area contact, and a level partial slide surface (51, 53) in the strip transport direction (33), ahead of and after the center zone (52), in each instance, for smooth contact with the horizontal parts of the support guideways (32).

2. Stentering machine according to claim 1, wherein the center zone (52) of the slide surface (31) in each instance, is approximately just as long as the two level partial slide surfaces (51, 53) together.

3. Stentering machine according to claim 1, wherein the length ratio between the center zone (52) and the two level partial slide surfaces (51, 53) is adapted to a different stress.

4. Stentering machine according to claim 1, wherein the radius of curvature (R) of the center zone (52) is selected in accordance with the radius of curvature of the deflection zone (9).

* * * * *